United States Patent [19]

Noble et al.

[11] 3,949,554

[45] Apr. 13, 1976

[54] HEAT ENGINE

[75] Inventors: Jack E. Noble; Peter Riggle, both of Benton City; Stuart G. Emigh; William R. Martini, both of Richland, all of Wash.

[73] Assignee: The United States of America as represented by the United States National Institute of Health, Washington, D.C.

[22] Filed: Oct. 10, 1974

[21] Appl. No.: 513,872

Related U.S. Application Data

[62] Division of Ser. No. 328,075, Jan. 30, 1973, Pat. No. 3,855,795.

[52] U.S. Cl. ..... 60/521; 123/74 R

[51] Int. Cl.[2] ..... F01B 29/10

[58] Field of Search ..... 60/516, 517, 521; 123/74 R, 74 AE, 74 AC, 74 A, 74 D

[56] References Cited

UNITED STATES PATENTS

| | | | |
|---|---|---|---|
| 3,472,478 | 10/1969 | Sherwood | 60/516 X |
| 3,491,554 | 1/1970 | Granryd | 60/516 X |
| 3,645,649 | 2/1972 | Beale | 60/517 X |
| 3,670,494 | 6/1972 | Papp | 60/516 |

*Primary Examiner*—Martin P. Schwadron
*Assistant Examiner*—H. Burks, Sr.
*Attorney, Agent, or Firm*—Holman & Stern

[57] ABSTRACT

A regenerative heat engine designed to produce power for the operation of equipment such as an artificial heart is disclosed. The heat engine includes a temperature control heat pipe located around the periphery of the engine cylinder and a temperature distribution heat pipe located around the periphery of the heat source. A flywheel and bellows seal is included as part of the displacer piston drive, and a flexure support is positioned on the hot end of the displacer piston to allow the piston to move longitudinally while restricting lateral motion.

3 Claims, 9 Drawing Figures

HEAT ENGINE

This is a divisional of application Ser. No. 328,075, filed Jan. 30, 1973 now U.S. Pat. No. 3,855,795.

BACKGROUND AND SUMMARY OF THE INVENTION

The present invention relates to a regenerative heat engine. More particularly, the present invention relates to a minature heat engine which is designed to produce power for the operation of equipment such as an artificial heart.

In the operation of power sources for equipment such as artificial heart pumps in which continuous operation is critical, previous sources of power have been characterized by many inherent disadvantages, including excessive size and weight, inefficiency, poor reliability, and equipment complexity which have made difficult the process of assembly and disassembly. Additional drawbacks to such prior art power sources have included the necessity for providing electric power input at relatively short intervals and the build-up of heat around the power source which has precluded installation in or near the body of the patient.

By the present invention there is provided a power source for the operation of equipment such as an artificial heart in which the previously mentioned disadvantages have been overcome, the power source being in the form of a miniature regenerative heat engine. It is well known that Stirling engines (regenerative engines) possess certain advantages over the more widely used internal combustion engines, including quiet operation, potentially high efficiency and adaptability to the use of any of a large number of sources of heat including liquids, gases, solids, waste heat, electrically supplied heat and solar radiation. Stirling engines also require no ignition system, nor are carburetors or fuel injectors required, while relatively low speed operation can be employed. The many other advantages inherent in regenerative engines are well known to those skilled in the art. The Ideal Stirling cycle is characterized by isothermal compression followed by an addition of heat at constant volume from a regenerator, then an isothermal expansion, and finally a constant volume removal of heat for storage in the regenerator.

The regenerative cycle employed in the present invention is characterized by four sequential processes.

1. Heat leaves the regenerator and enters the gas at constant engine gas volume. Engine pressure rises.
2. Heat leaves the regenerator and enters the gas at constant pressure. Gas is expelled from the engine through a check valve into the high pressure reservoir.
3. Heat leaves the gas and enters the regenerator at constant engine gas volume. Engine pressure falls.
4. Heat leaves the gas and enters the regenerator at constant engine gas pressure. Gas returns to the engine through a check valve from the low pressure reservoir.

The present heat engine features increased reliability and efficiency, as well as ease of assembly and disassembly, and is capable of using heat supplied from various sources, including electric or radio isotope heat. The power output of the present heat engine is fully controllable. Preassembled inlet and outlet check valve modules are incorporated in the engine and a permanently sealed vacuum insulation package is maintained separate from the engine. Also incorporated in the engine is a thermal energy storage package so that the engine can operate for extended periods without power input. A temperature control heat pipe is installed to conduct any excess heat away from the hot end of the engine while a temperature distribution heat pipe is installed as a jacket around the heat source in order to distribute heat evenly over the hot end of the engine. Additional features of the present engine include a flexural support to support and guide the displacer at the hot end and a metal bellows seal for sealing off the displacer drive from the remainder of the engine.

Referring to the drawings.

Figure 5:
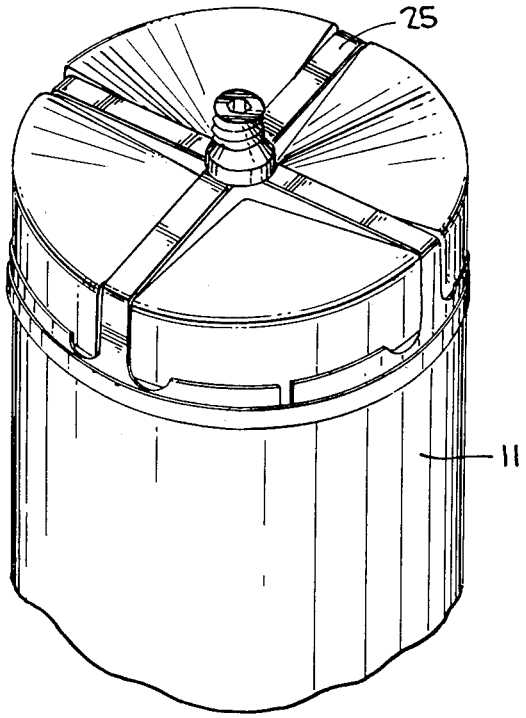
FIG. 5 is a perspective view of the flexural displacer support at the hot end of the present heat engine.
Figure 5A:
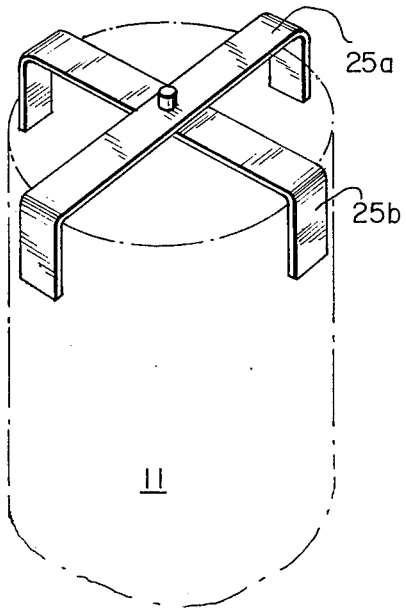
Figure 5B:
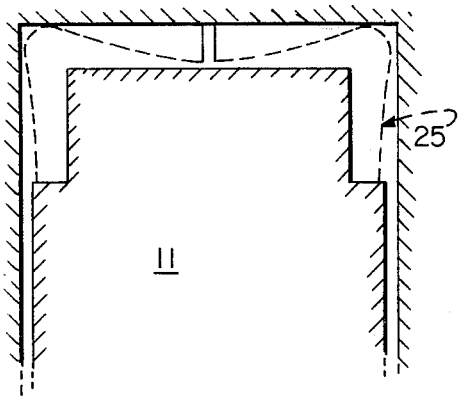
Figure 5C:
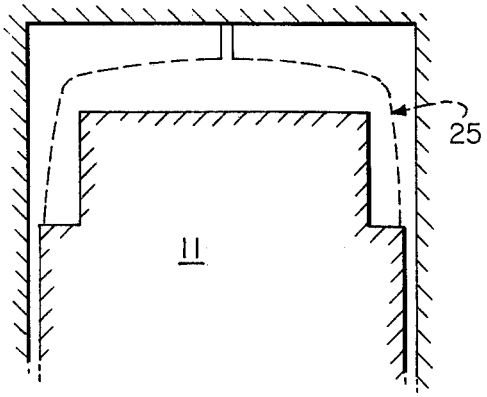
Figure 6:
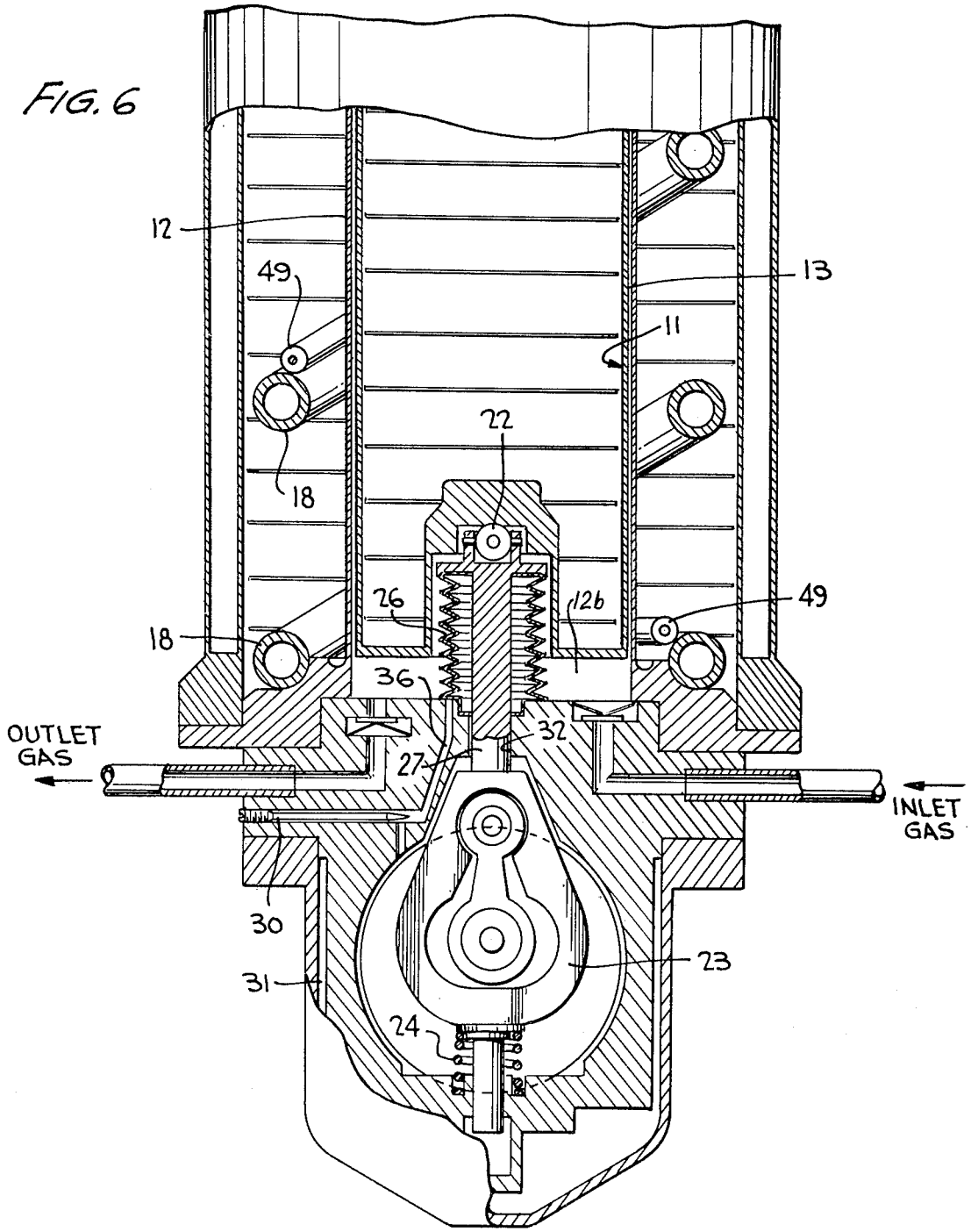

FIG. 5*a* is a functional schematic representation of the flexural displacer support of FIG. 5;

FIG. 5*b* is a cross-sectional view showing the shape of the flexure with the displacer piston in the up position;

FIG. 5*c* is a cross-sectional view showing the shape of the flexure with the displacer piston in the down position; and;

FIG. 6 is a sectional elevational view showing an alternative embodiment of the heat engine.

DESCRIPTION OF THE PREFERRED EMBODIMENTS

Figure 1:
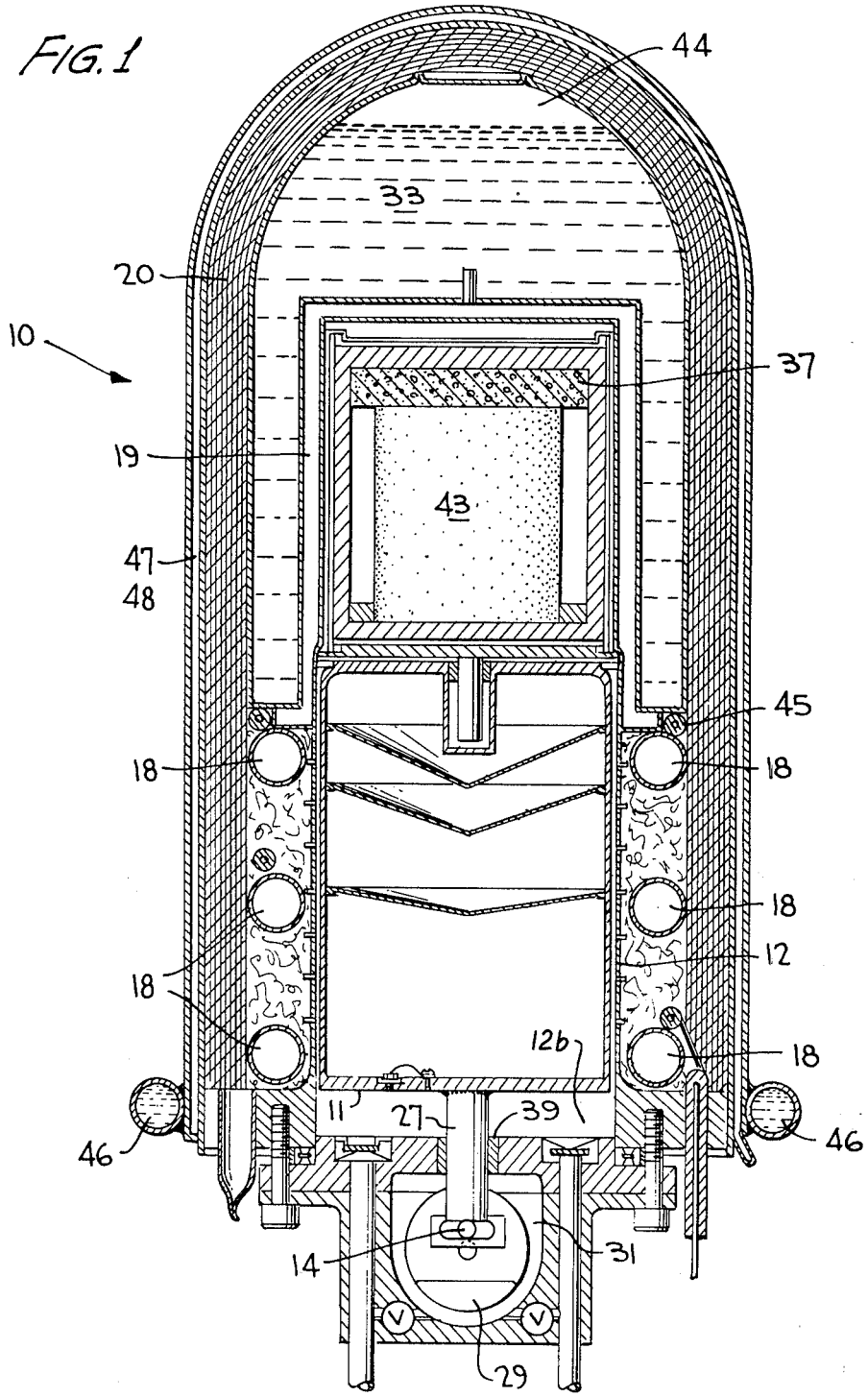
FIG. 1 is an elevational view in cross-section showing the heat engine of the present invention.
Figure 2:
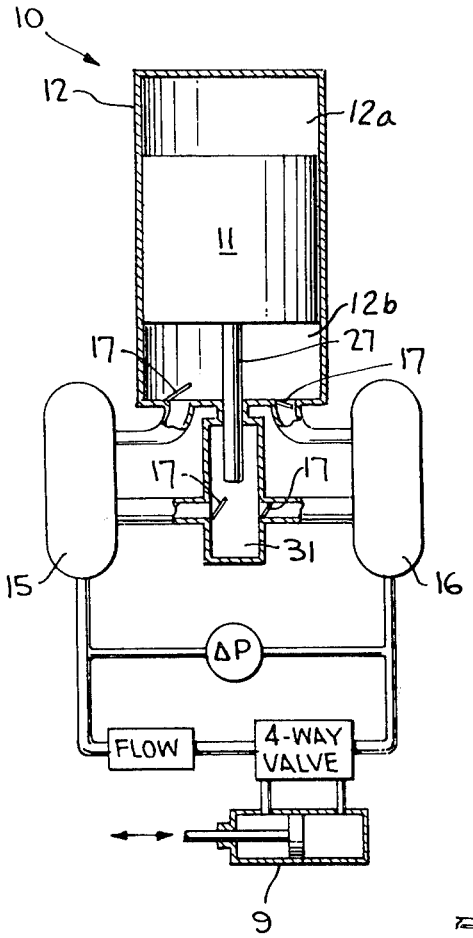
FIG. 2 is a schematic representation of the engine showing operation of the drive system and interconnection with a power takeoff apparatus.
Figure 3:
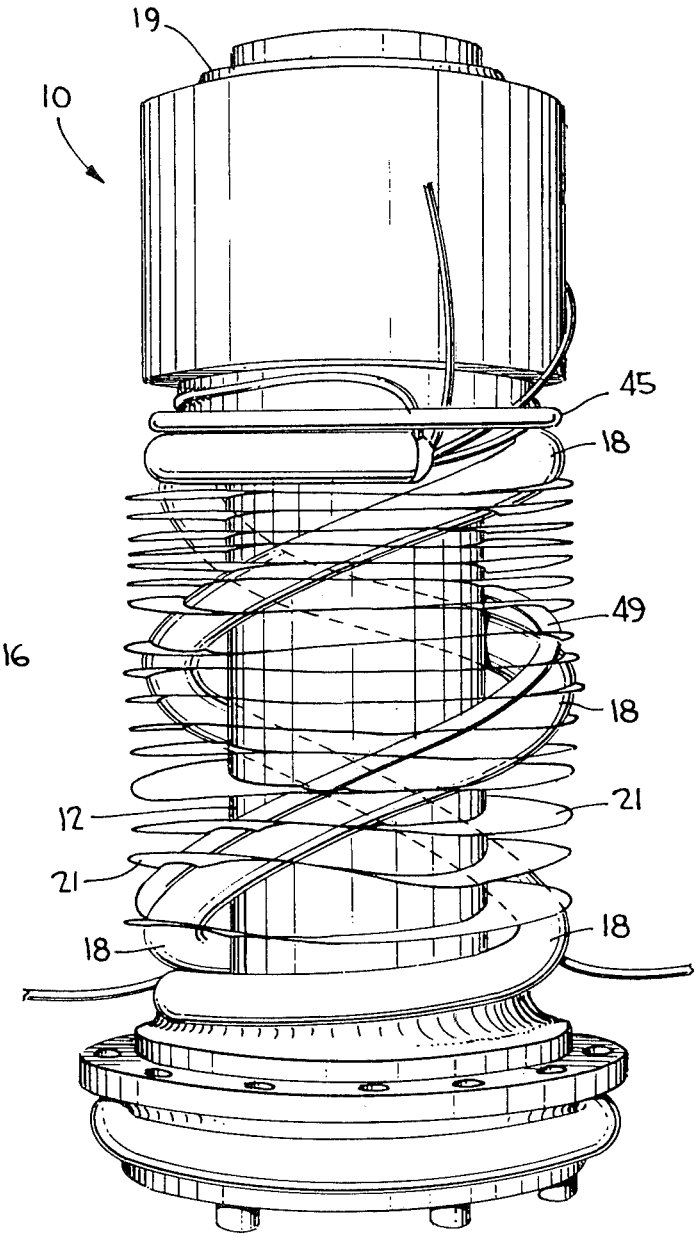
FIG. 3 is an elevational view similar to FIG. 1 showing the outer portion of the heat engine.

In the illustrated embodiment of the present invention as shown in FIGS. 1 through 3, apparatus 10 is provided for operation as a heat engine to produce pneumatic power. The apparatus includes a displacer piston 11 mounted for reciprocation within cylinder 12. The end portions of the cylinder 12 define, respectively, a hot chamber and a cold chamber. The displacer piston 11 is of a diameter such that only a slight clearance is maintained between the piston and the inner cylinder wall. This clearance in the form of an annulus, functions as the heater, regenerator, and cooler for the engine, with heat being transferred to and from the working gas as the gas passes through the annulus during reciprocation of the displacer piston 11. Thus, the outer sidewall of the displacer piston 11 and the inner sidewall of the cylinder 12 constitute the regenerator boundaries. Preferably, the clearance between the displacer piston 11 and the engine cylinder 12 is about 0.007 to 0.009 inch. The drive piston 27 seals the space between the engine cylinder 12 and a drive chamber 31. The displacer piston 11, which separates the hot and cold zones of the cylinder 12, may be fabricated of a low conductivity, heat resisting alloy in order to limit heat transfer between the two zones. The cylinder 12 is also preferably formed of such a material.

Referring to FIG. 2, working gas, such as helium, for operating the engine is pumped from a low-pressure tank 15 to a high pressure tank 16 and then expanded through an external load as represented by the piston and cylinder arrangement 9 to do useful work. Any gas or vapor-liquid combination may be used as a working fluid. What is needed is a fluid that is easy to heat and cool and has a large volume change for the amount of heat that must be transferred to effect that volume change. The fluid must be stable and non-corrosive. Helium gas has been found to be the most satisfactory for this engine. Check valves 17 ensure oneway flow from the low tank 15 to the engine cylinder 12 or drive chamber 31, and from the engine cylinder 12 and drive chamber 31 to the high pressure tank 16.

As shown in FIGS. 1 and 3, there is coiled around the outer circumference of the engine cylinder 12 a temperature control heat pipe 18 which is secured to the cylinder 12 in thermal communication with the hot chamber of the cylinder for the purpose of conducting excess heat from the hot end of the engine, to the cold end. The heat pipe is formed from a hollow tube and may use a combination of inert gas such as xenon along with a working fluid such as cesium. A wick is provided within the heat pipe to provide capillary flow from the condenser, or cold end of the heat pipe, to the evaporator, or hot end of the heat pipe.

The heat pipe 18 is in thermal communication with the upper or hot chamber 12*a* of the cylinder 12 so that as the temperature rises in the hot chamber, the inert gas is forced into the lower end of the heat pipe 18 with heat thus being transferred to the lower or cold chamber 12*b* of the cylinder 12. Sufficient working fluid should be present within the heat pipe to allow total wetting of the wick (not shown), in accordance with known heat pipe technology, while sufficient inert gas should be present so that at the operating temperature of up to about 1300°F., the inert gas will prevent the working fluid vapor from leaving the hot end of the heat pipe. At an overtemperature condition of approximately 1400°F., the working fluid vapor will reach the cold end of the heat pipe thereby carrying away excess heat from the hot end. By wrapping the heat pipe 18 around the cylinder 12 in the form of a coil, the length of the pipe 18 can be increased over that of a straight pipe, thus minimizing conduction when the heat pipe is inoperative.

When the proper amount of gas and liquid has been installed in the heat pipe 18 to give the desired control temperature the heat pipe fill tube may then be closed off. Upon insertion of the engine assembly into the cup-shaped vacuum foil insulation 20 and the control temperature having been reached, the heat pipe 18 is conductive over its entire length and conducts excess heat away from the hot end of the engine. A water-cooled heat removal loop 46 extends around the outer base of the heat engine to provide a cooling sink for the cold end of cylinder 12. Radiation shields 21 in the form of annular fins may be attached to the outer circumference of the engine cylinder 12 as shown in FIG. 3.

Located around the outer circumference of the upper or hot end 12*a* of the cylinder 12 is a distribution heat pipe 19, preferably in the form of a cylindrical shell of metal. The distribution heat pipe 19, which is in thermal communication with the hot chamber of the cylinder, extends around the heat source 43 and is located within the heat storage container 33. A heat pipe working fluid such as potassium is employed to distribute heat evenly around the hot end of cylinder 12.

The piston rod 27 extends through a suitable bearing 39 which seals off the cylinder 12 from the crankcase 31. The lower extremity of the piston rod 27 is connected to a crank shaft 14 and a flywheel 29 is secured to the crank shaft 14. In an alternative embodiment as shown in FIG. 6, a bellows seal 26 is provided to seal off the lower or cold end 12*b* of the cylinder 12 from the crankcase 31. The bellows seal 26 is attached at its upper end to the drive piston 27 and at the lower end to the lower inner surface of the cylinder, surrounding the opening from the cylinder 12 to the crankcase 31. The bellows seal 26 acts as a drive piston and positively separates the lubricated crankcase from the nonlubricated displacer and valves. Thus the gas in the cylinder 12 is separated from the gas and lubricants maintained within the crankcase. Also, as shown in FIG. 6, the displacer piston 11 is supported at the bottom on piston 27 by a pivoted coupling 22 to compensate for any misalignment between the displacer 11 and the shuttle 23 which controls the reciprocating motion of the displacer 11.

Figure 4:
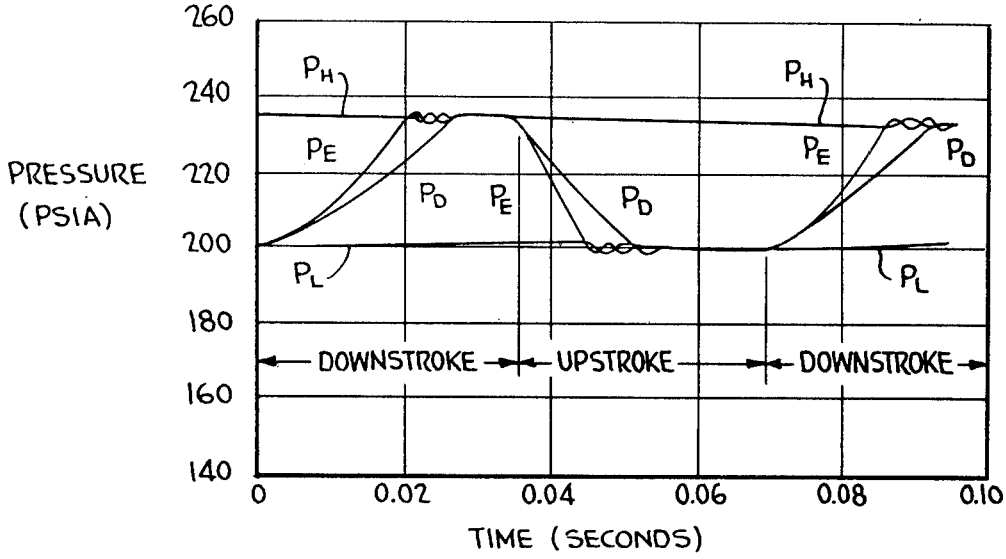
FIG. 4 is a graph showing cylinder and crankcase pressure as a function of the displacer piston of the heat engine.

During the down stroke of the displacer piston 11, gas pressure in the cylinder 12 rises faster than gas pressure in the drive chamber 31, as shown in the graph in FIG. 4. The resultant pressure drop across the bellows seal results in a reenforcing downward force which pushes the displacer piston 11 down and overcomes the spring 24, mechanical friction, and windage. At the end of the down stroke, inertia of flywheel 29 starts the displacer 11 on the upward stroke.

Energy is stored in the mechanical spring 24 during the downstroke of the displacer and this energy maintains displacer motion during the upward portion of the stroke. In this way it is possible to maintain a continual drive force and thus a relatively constant angular velocity of the crank without applying a reverse pressure differential to the bellows during the upward stroke. The drive chamber is held at essentially a constant pressure equal to the lowest pressure ($P_L$) in the engine chamber. By this means, "squirm" of the bellows due to internal pressurization, which would limit its usefulness, is avoided.

The displacer piston 11 is supported and guided at its upper or hot end by a flexure 25, shown in FIG. 5, in the form of a leaf spring which is adapted to operate at hot end temperatures in the range of about 1200° 1300°F. and thus to allow the displacer piston 11 to move longitudinally while restricting lateral motion. The flexure 25 is attached to the displacer piston 11 at the outer end portions of the flexure 25 while at the center, the flexure 25 is attached to the cylinder 12 with a threaded fastener which permits rotation of the displacer piston relative to the cylinder without binding. FIG. 5a is a functional schematic view of the flexure showing flexure 25a resisting a lateral force $F_2$ by reaction forces $V_2$, and reaction moments $M_2$ which resist overturning of the flexure. Lateral force $F_1$ is resisted by flexure 25b with similar reaction forces and moments $V_1$ and $M_1$. In this way a lateral force in any direction is resisted by a combination of the reaction forces and moments shown. FIGS. 5*b* and 5*c* are cross-sectional views of the diagram of FIG. 5*a* showing the shape of the flexures with the displacer piston 11 in the up and down positions, respectively. The ability of the flexure leg to deflect laterally allows vertical motion of the displacer piston with mainly flexural stresses only imposed in the flexure, minimizing restraint to displacer motion. The described action of the flexural leg allows motion of the supported article which is large relative to the thickness of the flexure itself while still retaining a high degree of rigidity in the lateral direction. By proper proportioning of displacement upward and displacement downward, stresses in the flexure can be minimized to give maximum flexure life.

An engine speed control valve 30 is provided in the crankcase 31, as shown in FIG. 6. The valve 30 is interconnected with the vent 36 which is provided for passage of gas between the under side of the bellows 26 and the crankcase 31. By throttling gas from behind the bellows seal 26 into the crankcase 31, employing the valve 30 in conjunction with suitable control apparatus, some of the drive energy is absorbed in a controlled flow friction and engine speed is thereby regulated. For effective control of the engine spaced, the bearing surface 32 at the top end of the shuttle 23 must be substantially gas tight.

In order for the heat engine to be able to operate for extended periods of time while not connected to an external power source, it is necessary that the thermal storage container 33 have an unusually high heat storage capacity. As the quantity of heat storage substance is preferably held to a minimum due to space and weight limitations, it is necessary that the substance have a high heat of fusion and that its melting point be within the operating temperature range of the engine. High temperature corrosion resistant materials, such as stainless steel, may be employed for the hot end of the engine to enable high melting point heat storage substances to be used.

Some of the better thermal energy storage materials are shown in table 1:

| Material | Melting Pt. °C | Heat of Fusion | Liquid Density at melting pt. g/cm³ |
|---|---|---|---|
| NaF | 992 | 0.468 | 1.94 |
| LiF | 848 | 0.568 | 1.80 |
| $BeF_2$ | 803 | ~0.49 | ~1.7 |
| LiF-40 % by weight NaF | 652 | 0.441 | 2.06 |
| LiF-30.5 % by weight LiCl | 500 | 0.370 | 1.78 |
| LiF-34 w/o $BeF_2$ | 455 | ~0.41 | 1.98 |

For each melting point these materials have the highest volumetric heat of fusion of any material known. The materials are generally salts of light alkali metals and light halogens. To be non corrosive in stainless steel they must be carefully dried before use. Preferably, the thermal storage container 33 is filled with a mixture of sodium fluoride and lithium fluoride having a melting point of about 650°C. Such a mixture will melt during periods of low heat demand by the engine and freeze during periods of high heat demand.

An electric heater 45 may be provided to aid in heating the heat storage substance. The power line 49 for the heater 45 may be conveniently aligned with the temperature control heat pipe 18, as shown in FIGS. 1 and 3, and 6. An expansion space 44 is provided at the upper portion of the thermal storage container 33. Heat is supplied to the engine by a heat source 43 which may be a radioisotope such as plutonium-238. A suitable spacer material 37 such as, for example, a tantalum foam material, is positioned around the heat source material 43. A low temperature heat pipe 47 is installed inside the outer shell 48 of the heat engine 10 to aid in distribution of heat around the outer periphery of the engine.

The present heat engine is capable of producing about 7 watts of pneumatic power from either radioisotope or electric heat. The engine is designed for minimum size and weight for full implantation as a power source for an artificial heart.

It is thought that the invention and many of its attendant advantages will be understood from the foregoing description and it will be apparent that various changes may be made in the form, construction and arrangement of the parts without departing from the spirit and scope of the invention or sacrificing all of its material advantages, the forms hereinbefore described being merely preferred embodiments thereof.

What is claimed is:

1. In a heat engine operating on a regenerative cycle and having a cylinder, a displacer piston reciprocably mounted within said cylinder to form a lower cold chamber and an upper hot chamber, a crankcase adjacent the cylinder, means for controlling the reciprocating motion of said displacer piston disposed within said crankcase, and drive piston means connecting said displacer piston and said control means, said crankcase being in communication with said cylinder in order to allow said drive piston to transmit motion from said control means to said displacer piston, the improvement comprising a bellows seal attached at one end thereof to the lower end of said displacer piston and at the other end thereof to the inner wall of said lower end of said cylinder around the opening through which said crankcase communicates with said cylinder and through which said drive piston means passes, said bellows seal being effective to seal off said crankcase from said cylinder.

2. The heat engine of claim 1, further including pivoted coupling means connecting said lower end of said displacer piston and the upper end of said drive piston means.

3. The heat engine of claim 1, further including a vent for passage of gas between the under side of the bellows and the crankcase, and valve means for controlling the passage of gas through said vent.

* * * * *